US009546039B1

(12) United States Patent
Lawrence

(10) Patent No.: US 9,546,039 B1
(45) Date of Patent: Jan. 17, 2017

(54) CONTAINER LINER WITH RIGID DISCHARGE STRUCTURE

(71) Applicant: Freedom Manufacturing LLC, Saratoga Springs, NY (US)

(72) Inventor: Jon Lawrence, Greenfield Center, NY (US)

(73) Assignee: Freedom Manufacturing LLC, Saratoga Springs, NY (US)

( * ) Notice: Subject to any disclaimer, the term of this patent is extended or adjusted under 35 U.S.C. 154(b) by 47 days.

(21) Appl. No.: 14/793,846

(22) Filed: Jul. 8, 2015

(51) Int. Cl.

| | |
|---|---|
| ***B65D 77/06*** | (2006.01) |
| ***B65D 90/04*** | (2006.01) |
| ***B65D 88/02*** | (2006.01) |
| ***B65D 88/54*** | (2006.01) |
| ***B65D 33/02*** | (2006.01) |
| ***B65D 33/01*** | (2006.01) |
| *B65D 77/04* | (2006.01) |

(52) U.S. Cl.
CPC ..... *B65D 90/046* (2013.01); *B65D 33/01* (2013.01); *B65D 33/02* (2013.01); *B65D 88/02* (2013.01); *B65D 88/54* (2013.01); *B65D 77/0486* (2013.01); *B65D 77/06* (2013.01)

(58) Field of Classification Search
CPC ..... B65D 90/046; B65D 33/01; B65D 33/02; B65D 88/02; B65D 88/54; B65D 77/06; B65D 77/0486
See application file for complete search history.

(56) References Cited

U.S. PATENT DOCUMENTS

| | | | | |
|---|---|---|---|---|
| 4,635,814 | A * | 1/1987 | Jones | B65D 77/06 220/495.04 |
| 4,947,988 | A | 8/1990 | Schutz | |
| 5,067,636 | A * | 11/1991 | Pfeiffer | B65D 77/06 222/105 |
| 5,154,308 | A * | 10/1992 | Larson | B65D 77/06 220/288 |
| 5,163,485 | A * | 11/1992 | Hermann | B65D 88/62 141/10 |
| 5,169,019 | A * | 12/1992 | Budenbender | B65D 77/06 220/495.08 |
| 5,385,268 | A | 1/1995 | LaFleur et al. | |
| 5,678,688 | A | 10/1997 | Schutz | |
| 5,794,670 | A | 8/1998 | LaFleur | |
| 5,836,363 | A | 11/1998 | LaFleur | |
| 5,851,072 | A | 12/1998 | LaFleur | |
| 5,897,012 | A | 4/1999 | Sortwell | |
| 6,244,459 | B1 | 6/2001 | Bouc et al. | |
| 6,305,845 | B1 | 10/2001 | Navin | |

(Continued)

*Primary Examiner* — Frederick C Nicolas
(74) *Attorney, Agent, or Firm* — Michael F. Hoffman; Hoffman Warnick LLC

(57) ABSTRACT

A liner discharge structure, and associated liner and container system are disclosed. The liner discharge structure includes: a collar fabricated from a liner material, wherein the collar encapsulates an O-ring in the liner material; a substantially rigid section having an opening, wherein the substantially rigid section is fabricated from the liner material; and a neck fabricated from the liner material, wherein the neck provides a passageway extending between the opening in the substantially rigid section and the collar; wherein the liner material used to fabricate the substantially rigid section has a cross-sectional thickness greater than the liner material used to fabricate the neck.

20 Claims, 3 Drawing Sheets

(56) References Cited

U.S. PATENT DOCUMENTS

| | | | | |
|---|---|---|---|---|
| 6,505,657 | B1 | 1/2003 | Lawrence | |
| 7,140,490 | B2 | 11/2006 | Przytulla | |
| 8,746,500 | B2 * | 6/2014 | Bernard | B65D 88/54 215/43 |
| 2004/0089667 | A1 * | 5/2004 | Gargano | F16L 55/1108 220/601 |
| 2006/0023973 | A1 * | 2/2006 | Plunkett | B65D 75/5877 383/22 |

* cited by examiner

CONTAINER LINER WITH RIGID DISCHARGE STRUCTURE

TECHNICAL FIELD

The subject matter of this invention relates to container liners, and more particularly to a container liner having a reinforced discharged structure to improve liner performance.

BACKGROUND

Bulk containers, including tanks and totes, are used in many applications to hold and ship fluids. Illustrative fluids may for example include industrial liquids, such as chemicals and paints, as well as consumer products such as lotions and other beauty products. Regardless, in many applications, a key challenge is the need to avoid or eliminate contamination within the container. For instance, introduction of a foreign substance into a high performance chemical can ruin the entire contents of the container. In other cases, the FDA may have extremely stringent standards for liquid products stored in containers that are to be consumed or applied to people.

One way to eliminate contamination in a container is to utilize a liner that can be disposed of after each use. For example, U.S. Pat. No. 6,505,657, entitled "Container Liners and Methods of Lining Containers," issued on Jan. 14, 2003, the contents of which is hereby incorporated by reference, teaches a liner system for use with tanks, such as an intermediate bulk container (IBC). In such an application, the liner is adapted to conform to the inner surface of the container, so as to not interfere with any product contained therein.

While the use of liners greatly enhances the performance, lifespan and usability of a container, liners present various challenges. One such challenge is the need to ensure that the liner is easy to install and does not interfere with the operation of the container. For example, a typical container may have a discharge opening at the bottom for discharging fluids through a valve. Under certain circumstances, the liner can slip within the tank and interfere with the opening. Another challenge is the need to ensure that the liner material is compatible with whatever fluid is being held therein. This greatly limits the use of liners having sections made of different materials to achieve performance requirements.

Accordingly, there exists a need for a container liner that can be easily manufactured to meet the performance demands required for many of today's applications.

SUMMARY

A first aspect provides a liner discharge structure adapted for use with a container liner, the liner discharge structure comprising: a collar fabricated from a liner material, wherein the collar encapsulates an O-ring in the liner material; a substantially rigid section having an opening, wherein the substantially rigid section is fabricated from the liner material; and a neck fabricated from the liner material, wherein the neck provides a passageway extending between the opening in the substantially rigid section and the collar; wherein the liner material used to fabricate the substantially rigid section has a cross-sectional thickness greater than the liner material used to fabricate the neck.

A second aspect provides a liner for a container, comprising: a liner body that is shaped and adapted to conform to an inner wall of the container, wherein the liner body is fabricated from a liner material; and a liner discharge structure attached to a liner opening in the liner body, the liner discharge structure comprising: a collar fabricated from the liner material, wherein the collar encapsulates an O-ring in the liner material; a substantially rigid section having an opening, wherein the substantially rigid section is fabricated from the liner material; and a neck fabricated from the liner material, wherein the neck provides a passageway extending between the opening in the substantially rigid section and the collar; wherein the liner material used to fabricate the substantially rigid section has a cross-sectional thickness greater than the liner material used to fabricate the liner body.

A third aspect provides a container system, comprising: a container having a discharge opening for receiving a removable valve; and a liner, the liner having: a liner body that is shaped and adapted to conform to an inner wall of the container, wherein the liner body is fabricated from a liner material; and a liner discharge structure attached to a liner opening in the liner body, the liner discharge structure adapted to be seated within the discharge opening, and having: a collar fabricated from the liner material, wherein the collar encapsulates an O-ring in the liner material; a substantially rigid section having an opening, wherein the substantially rigid section is fabricated from the liner material; and a neck fabricated from the liner material, wherein the neck provides a passageway extending between the opening in the substantially rigid section and the collar; wherein the liner material used to fabricate the substantially rigid section has a cross-sectional thickness greater than the liner material used to fabricate the liner body.

BRIEF DESCRIPTION OF THE DRAWINGS

These and other features of this invention will be more readily understood from the following detailed description of the various aspects of the invention taken in conjunction with the accompanying drawings in which.

Figure 1:
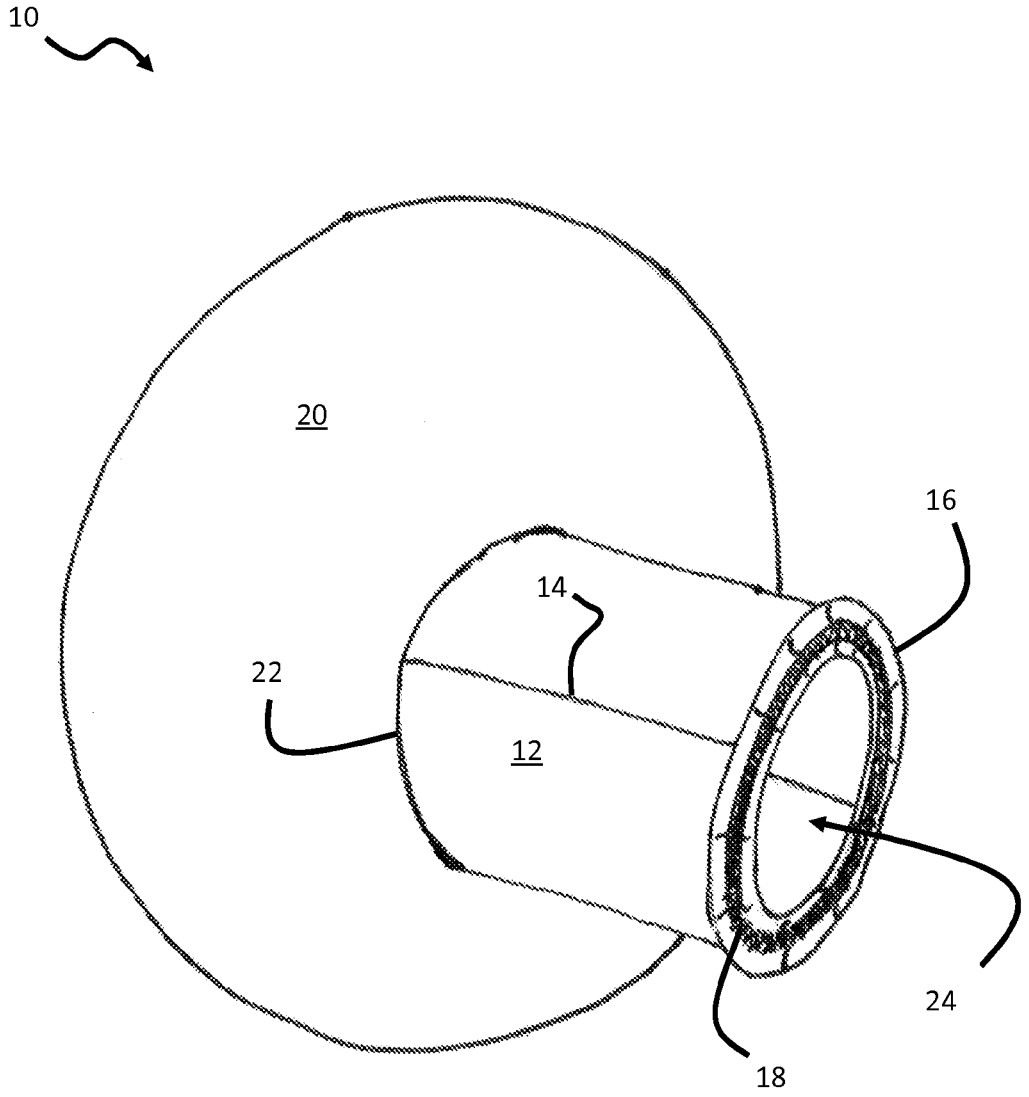
FIG. 1 shows a liner discharge structure adapted for a discharge opening of a container according to embodiments.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

Figure 2:
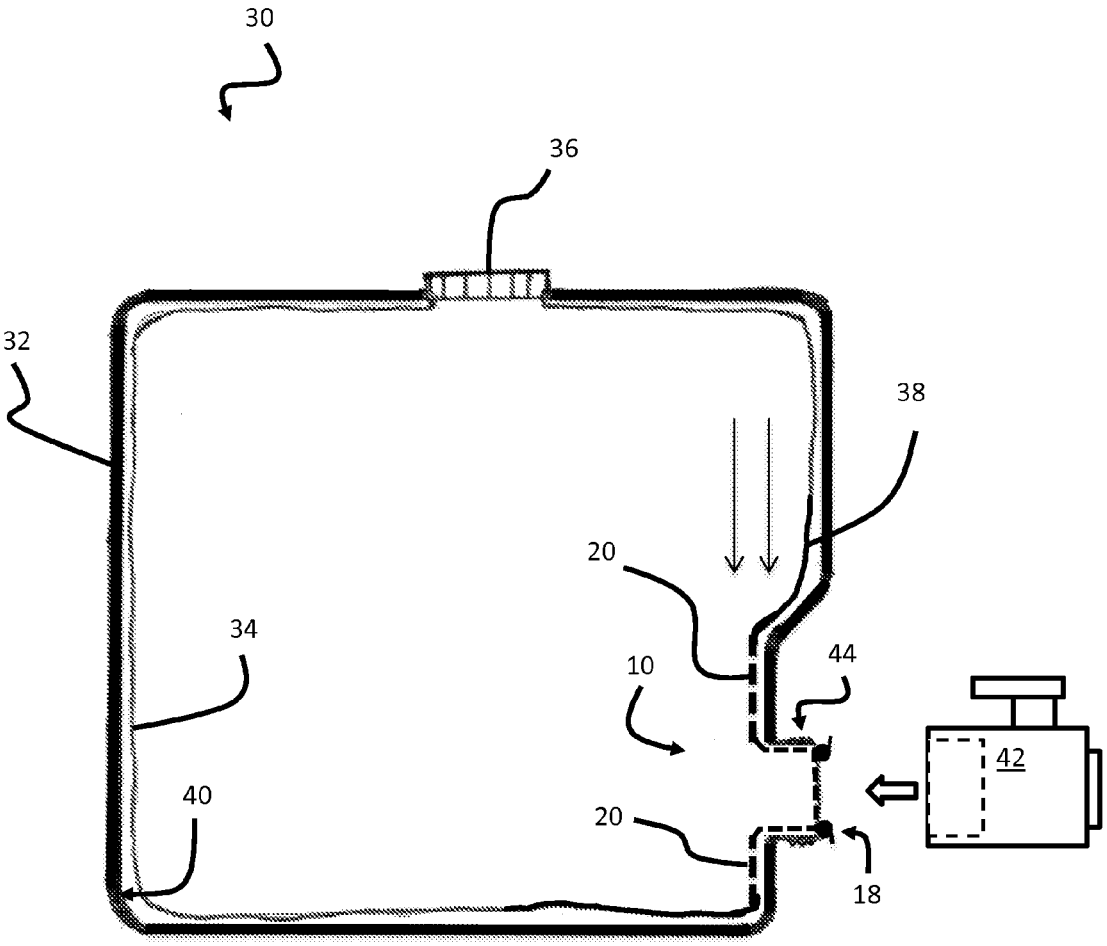
FIG. 2 shows a container having a liner with the liner discharge structure of FIG. 1 according to embodiments.

Referring now to the drawings, FIG. 1 depicts a liner discharge structure 10 that can be integrated into a container liner for placement in a discharge opening of a container. An illustrative container 30 with a liner that includes liner discharge structure 10 is shown in FIG. 2. In general, liner discharge structure 10 is fabricated separately from the liner body 34 and is thereafter attached to an opening in a liner body (liner body not shown in FIG. 1) using any technique that does not introduce any foreign material, e.g., heat sealing, vibration welding, ultrasonic welding, etc.

As shown in FIG. 1, liner discharge structure 10 generally includes a substantially rigid section 20, a neck 12, and a collar 16 that fully encapsulates an O-ring 18. A feature of liner discharge structure 10 is that the entire structure 10, with the exception of encapsulated O-ring 18 is fabricated from the same material as the liner body 34 to which it will be attached. Thus, the entire surface area of both the liner discharge structure 20 and associated liner body 34 is homogeneous so as to ensure compatibility with the fluids contained therein. The use of the same materials throughout also allows for easy manufacturing, i.e., there are no challenges associated with welding or sealing heterogeneous materials.

The particular shape and configuration of the liner discharge structure 10 is dependent, along with its associated liner body 34, on the container 30. For the purposes of this disclosure, the term container may refer to any tank, tote, vessel, etc., that is capable of storing fluids. Further, such containers may be fabricated from any material, including PVC, metal, composites, etc. In general, such containers include a discharge opening 44, typically near the bottom of the container 30 for discharging the fluid as shown in FIG. 2.

As noted, liner discharge structure 10 generally includes three regions, substantially rigid section 20, neck 12, and collar 16. As described herein, substantially rigid section 20 is fabricated with a cross-sectional thickness that is greater than that of the liner body 34 and neck 12. The increase thickness creates a stiffer region of the liner which acts to prevent the liner body 34 from slipping down and interfering with the passageway 24.

Neck 12 may for example be fabricated in a substantially tubular arrangement from one or more sections of liner material that is welded along seam 14. Neck 12 is also welded to substantially rigid section 20 along seam 22 to provide a passageway between an opening in section 20 and collar 16. Collar 16 may be fabricated using excess neck liner material along the edge of the neck and/or additional liner material. As noted, O-ring 18 is fully encapsulated in the collar material. As shown in FIG. 2, the encapsulated O-ring 18 replaces a valve O-ring used by a valve 42 that attaches to the discharge opening 44 on the container 30. This further eliminates any possibility of contamination.

The illustrative container 30 depicted in FIG. 2 generally includes a container wall 32, a filling port 36 and a discharge opening 44. Discharge opening 44 is configured to receive valve 42, e.g., with threading, for controlling discharge from the container 30. As can be seen, encapsulated O-ring 18 replaces the O-ring typically seated in valve 42. As shown, container 30 includes a liner that includes a liner body 34 and liner discharge structure 10 (shown in dashed lines), which is partially seated in discharge opening 44.

Although shown separated from inner surface 40 for ease of description, liner body 34 when installed is adapted to conform to the inner surface 40 using known techniques. Because liner body 34 is relatively pliable, once conformed, the liner body 34 essentially takes up no space and does not interfere with the operation of the container 30.

As can be seen, substantially rigid section 20 surrounds the discharge opening 44 to provide enhanced structural support for the liner body 34. In particular, because section 20 is thicker (and thus more rigid) than the liner body 34, section 20 helps ensure that, e.g., the liner portion 38, will not slide down and block the discharge opening 44. Although the liner body 34 is adapted to conform with the inner wall 40, gravity, changes in temperature, operating conditions, vibrations from transportation of the container, etc., will cause liner body 34 to gradually slide downwards as shown by the arrows. The rigidity provided by section 20 helps to offset any sliding that could block the opening.

Furthermore, because the entire liner discharge structure 10 is fabricated from the same material as the liner body 34 itself, no nonconforming materials are introduced. Use of the same material also allows liner discharge structure 10 to be easily attached to the liner 34 with known techniques. In a typical embodiment, the liner material may comprise a multilayer substrate having properties compatible with the fluid to be place in the container 30. Accordingly, selection of the liner material may change from application to application. The only requirement is that the same liner material be used for both the liner body 34 and liner discharge structure 10 to ensure a homogeneous containment environment.

Figure 3:
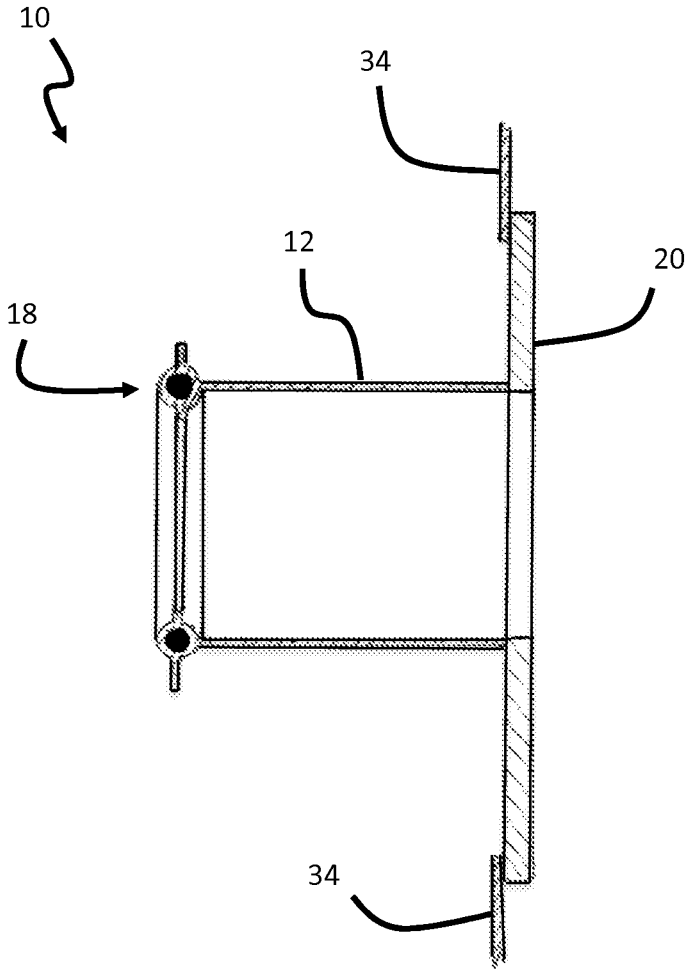
FIG. 3 shows a cut-away cross-sectional view of the liner discharge structure of FIG. 1 according to embodiments.

FIG. 3 depicts a cutaway cross-sectional view of an illustrative liner discharge structure 10 that is shown sealed to liner 34. As can be seen, substantially planar section 20 has a greater than the cross-sectional thickness of liner body 34. In one embodiment, section 20 may be fabricated with a thickness that is five times greater than liner body 34. However, it is understood that any thickness that achieves an appropriate amount of rigidity of section 20 may be utilizes, e.g., section 20 may be 3-10 times thicker than the liner material. Fabricating a thicker cross-section for section 20 may be achieved by simply stacking sheets of liner material in a coplanar arrangement, and then adhering the sheets together with any known process, such as a heat press.

As noted herein, the particular size and configuration of the liner discharge structure 10 is dependent upon the container in which it will be used. For example, in some instances, the discharge opening 44 may be oriented downward from the bottom of a cone-shaped container, creating a potential for the liner body to slide downward from any direction. In such a case, section 20 may be adapted to provide an equal amount of rigidity about the entire opening. Moreover, although described as substantially planar, section 20 could be fashioned in a non-planar form, e.g., conical, rounded, etc., to conform the inner wall surface proximate the discharge opening.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A liner discharge structure adapted for attachment to a container liner, the liner discharge structure comprising:

a collar fabricated from a liner material, wherein the collar encapsulates an O-ring in the liner material;

a substantially rigid section having an opening, wherein the substantially rigid section is fabricated from the liner material; and a neck fabricated from the liner material, wherein the neck provides a passageway extending between the opening in the substantially rigid section and the collar;

wherein the liner material used to fabricate the substantially rigid section has a cross-sectional thickness greater than the liner material used to fabricate the neck.

2. The liner discharge structure of claim 1, wherein the liner material comprises a multilayer sheet of pliable material.

3. The liner discharge structure of claim 1, wherein the substantially rigid section is substantially planar.

4. The liner discharge structure of claim 1, wherein the substantially rigid section has a cross-sectional thickness that is three to ten times thicker than the liner material used to fabricate the neck.

5. The liner discharge structure of claim 1, wherein the substantially rigid section is formed from a stack of liner material.

6. The liner discharge structure of claim 1, wherein the neck is substantially tubular.

7. A liner for a container, comprising:

a liner body that is shaped and adapted to conform to an inner wall of the container, wherein the liner body is fabricated from a liner material; and a liner discharge structure attached to a liner opening in the liner body, the liner discharge structure comprising:

a collar fabricated from the liner material, wherein the collar encapsulates an O-ring in the liner material;

a substantially rigid section having an opening, wherein the substantially rigid section is fabricated from the liner material; and a neck fabricated from the liner material, wherein the neck provides a passageway extending between the opening in the substantially rigid section and the collar;

wherein the liner material used to fabricate the substantially rigid section has a cross-sectional thickness greater than the liner material used to fabricate the liner body.

8. The liner of claim 7, wherein the liner body comprises a multilayer sheet of pliable liner material.

9. The liner of claim 7, wherein the substantially rigid section is substantially planar.

10. The liner of claim 7, wherein the substantially rigid section has a cross-sectional thickness that is three to ten times thicker than the liner material used to fabricate the liner body.

11. The liner of claim 7, wherein the substantially rigid section is formed from a stack of liner material used to fabricate the liner body.

12. The liner of claim 7, wherein the neck is substantially tubular.

13. The liner of claim 7, wherein the liner discharge structure is attached to an inwardly facing surface in the liner body.

14. A container system, comprising:

a container having a discharge opening for receiving a removable valve; and a liner, the liner having:

a liner body that is shaped and adapted to conform to an inner wall of the container, wherein the liner body is fabricated from a liner material; and a liner discharge structure attached to a liner opening in the liner body, the liner discharge structure adapted to be seated within the discharge opening, and having:

a collar fabricated from the liner material, wherein the collar encapsulates an O-ring in the liner material;

a substantially rigid section having an opening, wherein the substantially rigid section is fabricated from the liner material; and a neck fabricated from the liner material, wherein the neck provides a passageway extending between the opening in the substantially rigid section and the collar;

wherein the liner material used to fabricate the substantially rigid section has a cross-sectional thickness greater than the liner material used to fabricate the liner body.

15. The container system of claim 14, wherein the liner body comprises a multilayer sheet of pliable liner material.

16. The container system of claim 14, wherein the substantially rigid section is substantially planar.

17. The container system of claim 14, wherein the substantially rigid section has a cross-sectional thickness that is three to ten times thicker than the liner material used to fabricate the liner body.

18. The container system of claim 14, wherein the substantially rigid section is formed from a stack of liner material used to fabricate the liner body.

19. The container system of claim 14, wherein the neck is substantially tubular.

20. The container system of claim 14, wherein the liner discharge structure is attached to an inwardly facing surface in the liner body.

* * * * *